United States Patent [19]

Hanchett

[11] 4,017,107

[45] Apr. 12, 1977

[54] ELECTRIC DOOR STRIKE

[76] Inventor: Leland Hanchett, 211 Ridge St., Winchester, Mass. 01890

[22] Filed: Nov. 11, 1974

[21] Appl. No.: 522,340

[52] U.S. Cl. ..... 292/341.16

[51] Int. Cl.[2] ..... E05C 3/02

[58] Field of Search ..... 292/201, 341.16, 341.17, 292/144, 210

[56] References Cited

UNITED STATES PATENTS

| | | | |
|---|---|---|---|
| 322,681 | 7/1885 | Casey | 292/341.16 |
| 2,390,467 | 12/1945 | Schnur | 292/341.17 |
| 3,354,583 | 11/1967 | Moorman et al. | 292/201 X |

*Primary Examiner*—Richard E. Moore
*Attorney, Agent, or Firm*—Erwin Salzer

[57] ABSTRACT

An Electric Door Strike is disclosed wherein a notch is provided in a strike frame for receiving a latch or a dead bolt. A pivoting shutter is positioned adjacent the notch and is pivotable between an open position to admit the dead bolt when the latter is in its extended position, and a closed position wherein the notch receiving the dead bolt is partially covered. In the closed position the dead bolt may not be withdrawn from the strike frame except by being withdrawn into the door lock mechanism. The shutter is mounted on the shaft of a rotary solenoid which, when energized, pivots the shutter to the open position. A stop pin is secured to the shutter and engages a mating detent in the strike frame when the shutter is closed to prevent the shutter from being forced open from a position externally of the door. A latch spring is mounted within the strike frame in an interfering position with both the dead bolt and the shutter; the spring is urged, by contact with the dead bolt, out of the path of the shutter to permit the latter to pivot into its closed position.

3 Claims, 4 Drawing Figures

ELECTRIC DOOR STRIKE

The present invention pertains to door strikes and more particularly to electrically energizable apparatus for selectively placing a locking shutter in an open or closed position.

It is well known that the utilization of dead bolts provide significantly greater protection against intrusion than conventional spring loaded latch mechanisms. The dead bolts are usually mounted within the door and extend therefrom in the plane thereof to engage a mating or corresponding notch in a strike plate secured to the door jam. The dead bolts may be electrically actuated so that the door may be unlocked from a remote location; conversely, the door strike may be provided with an electrically actuated mechanism for releasing the dead bolt upon energization.

The electrical actuation of a latch or a dead bolt incorporates inherent problems including the complications surrounding the mounting of the latch or dead bolt on or in the door together with the associated mechanism and necessary wiring. Such mechanisms tend to be cumbersome for the limited space available; further, the wiring becomes an additional complicating factor on the door. The electrically actuated strike mechanisms also tend to become cumbersome and bulky thereby reducing the reliability and increasing the cost thereof.

It is, therefore, an object of the present invention to provide an electric strike mechanism with a minimum of moving parts.

It is also an object of the present invention to provide an electric strike that may be inexpensively constructed while nevertheless being compact.

It is still another object of the present invention to provide an electric door strike incorporating means to prevent forced operation thereof by an intruder.

It is still another object of the present invention to provide an electric door strike which will automatically assume a locked position when the dead bolt enters the notch provided therefore in the strike either by extension of the dead bolt from the door or closure of the door with the dead bolt extended.

The present invention may more readily be described by reference of the accompanied drawings in which.

Figure 4:
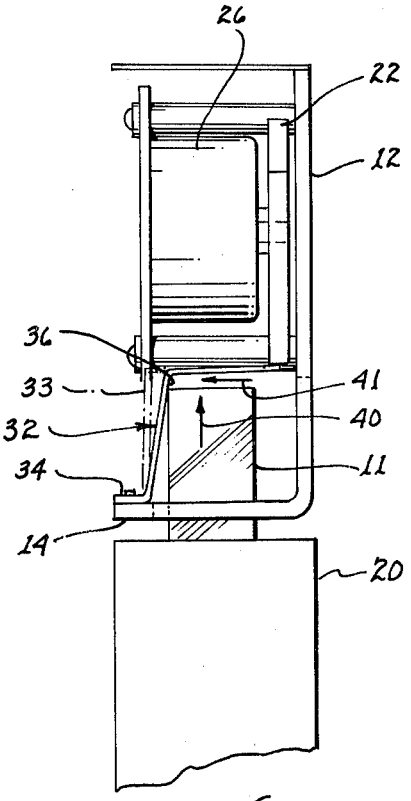
FIG. 4 is a sectional view of the electric strike of FIG. 2 taken along line 2—2.
Figure 1:
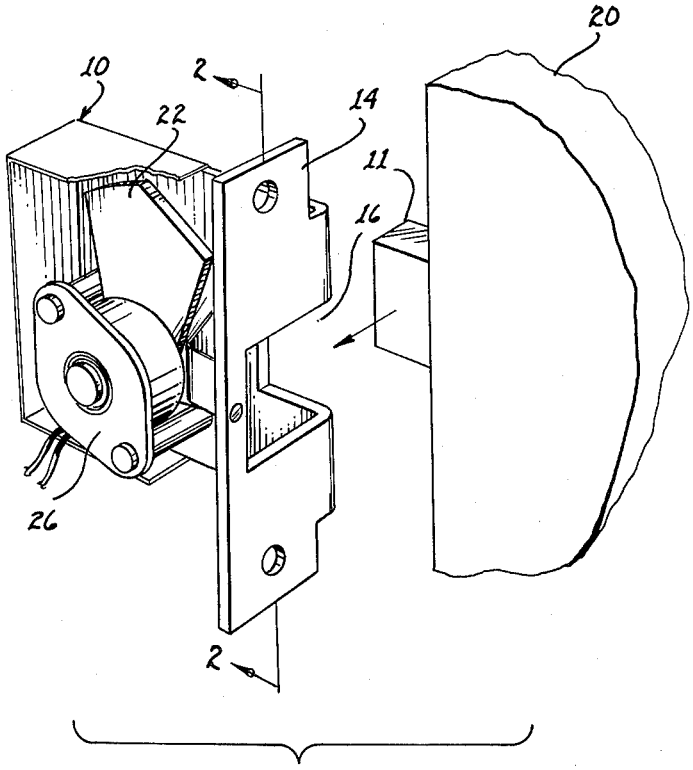
FIG. 1 is a perspective view of an electric strike constructed in accordance of the teaching of the present invention.
Figure 2:
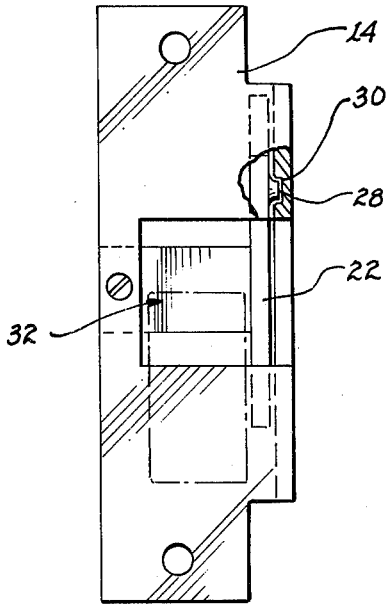
FIG. 2 is a front elevational view, partly in section, of the electric strike of FIG. 1.
Figure 3:
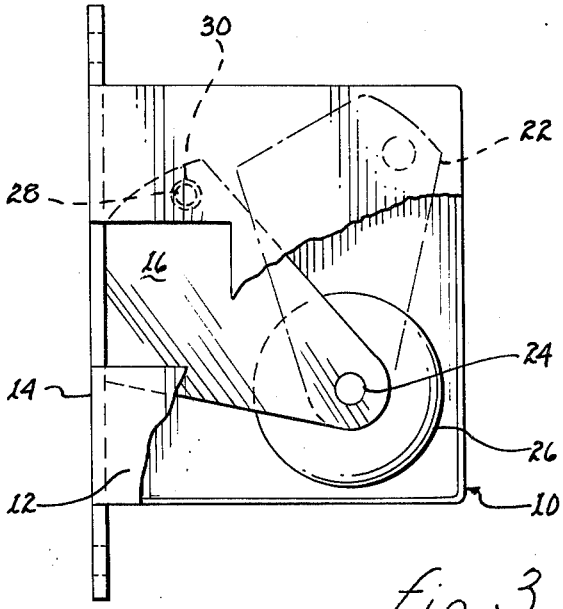
FIG. 3 is a side elevational view, partly in section, of the electric door strike of FIG. 1.

Referring now to the drawings, a strike frame 10 is formed into an "L" shape having front face plate 12 and a jam face plate 14. A notch 16 is formed in the face plate to permit a latch or dead bolt 11 to extend therein. The dead bolt may enter the notch 16 either by extending outwardly from a door, such as that shown at 20, after the door has been closed or by passing into the notch 16 as the door is closed with the dead bolt 11 already extended. In either case, the latch or dead bolt, when the door is closed, is positioned in the notch 16 and may be removed from the notch either by retracting the bolt into the door or simply opening the door with the bolt extended. To lock the door in the closed position, when the dead bolt is extended, a pivoting shutter 22 is provided which is mounted on the shaft 24 of a rotary solenoid 26. The shutter 22 is spring biased to the closed position and is opened upon energization of the solenoid 26. The spring biasing may be provided in any convenient manner; however, biasing springs are frequently incorporated in rotary solenoids urging the operating shafts thereof into a rest position. For example, it has been found that a LEDEX rotary solenoid Model H-1226–028 incorporates a biasing spring sufficient to adequately bias the shutter 22 to the closed position.

Professional burglars will sometimes attempt to induce rotation of the shutter 22 by drilling a hole through the wall adjacent to the door and inserting an object to attempt to rotate the shutter out of its locked or closed position. Such attempts are rendered unsuccessful in the present invention through the utilization of a stop pin 28 secured to the shutter which is aligned with a detent 30 provided in the strike frame face plate 12. While the pin 28 and detent are engaged, rotation of the shutter 22 is virtually impossible.

Most rotary solenoids, including the specific example cited above, exhibit slight axial movement of the drive shaft upon initial energization. This slight axial movement or "pulling in" results from the electrical magnetization of the materials when the field is first established. It has been found, for example, that an axial motion during this "pulling in" of approximately 0.035 inches is sufficient to initially withdraw the stop pin 28 from the detent 30 thus freeing the shutter 22 for pivotal movement on the shaft 24.

Since the shutter 22 is biased to the closed position, a latch spring 32 is used to temporarily lock the shutter in the open position after the dead bolt has been removed from the notch. The latch spring may take various forms; however, in the embodiment chosen for illustration a flat leaf-type spring 32 is formed having a leg 34 secured, such as by riviting, to the jam face plate 14. The spring then extends inwardly from the jam face plate at an angle, forming a contact surface 36. From the contact surface 36 the spring extends toward the shutter 22 and is positioned to interfere with the closing motion of the shutter.

It may be seen by an inspection of FIG. 4 that so long as the dead bolt 11 does not enter the notch 16, the latch spring 32 will maintain the shutter 22 in the open position. If the dead latch or dead bolt is extended from the door while the latter is closed in the direction of the arrow 40, the bolt will contact the surface 36 forcing the spring to the left as shown in FIG. 4 to a position indicated by the broken lines 33. The spring will thus be urged out of its interfering position thereby permitting the shutter 22 to move to its closed position. If the dead bolt 11 is already in its extended position when the door is closed, the motion of the dead bolt will be that indicated by the arrow 41; however, it may be seen that the bolt will nevertheless contact the spring 32 and urge it out of its intefering position thereby permitting the shutter to close. Thus, the latch spring 32 enables the shutter to be maintained in its open position while the dead bolt is not in the notch 16; movement of the dead bolt into the notch, either by extension of the bolt from the door or closure of the door with the dead bolt extended will result in movement of the latch spring out of the interfering position relative to the shutter 22.

The apparatus of the present invention, therefore, provides an electric strike having essentially one moving part which is simple in construction and reliable in operation. The apparatus provides protection against intrusion including attempts at external actuation of the shutter; further, the strike remains in a receptive state to receive the latch or dead bolt and will automatically close or lock upon contact with the dead bolt regardless of the manner in which the dead bolt enters the strike. It will be understood by those skilled in the art that while the embodiment chosen for illustration refers generally to a dead bolt, the electric strike nevertheless provides similar advantages when used with conventional latches.

Having thus described my invention, I claim:

1. Electric strike apparatus comprising a strike frame having a front face plate and a jam face plate; means defining a notch in said strike frame for receiving a latch or dead bolt; a rotary solenoid positioned adjacent said strike frame and having a shaft extending therefrom, said shaft rotatable between a first and second position; a shutter positioned adjacent said front face plate and tied to said shaft for joint movement with said shaft between said first position exposing said notch and said second position covering a portion of said notch to prevent passage of said latch or dead bolt through said portion of said notch; spring biasing means urging said shutter to said second position; and said electric strike apparatus further including a spring latch positioned adjacent said notch and extending into the path of said latch or dead bolt as said latch or dead bolt is extended into said notch, said spring latch extending into the path of said shutter as said shutter moves from said first position to said second position, said spring latch being urged out of the path of said shutter by contact with said latch or dead bolt.

2. Electric strike apparatus comprising a strike frame having a front face plate and a jam face plate; means defining a notch in said frame extending through said front face plate and said jam face plate for receiving a latch or dead bolt; a rotary solenoid positioned adjacent said strike frame and having a shaft extending therefrom, said shaft rotatable between a first position and a second position, said shaft also axially movable upon energization of said solenoid; a shutter positioned adjacent said front face plate and mounted on said solenoid shaft for movement between said first position exposing a portion of said notch in said strike frame and a second position covering said portion of said notch, said shutter permitting passage of said latch or dead bolt through said notch when in said first position and preventing passage of said latch or dead bolt through said notch when in said second position; spring biasing means connected to said shaft for urging said shaft and said shutter to said second position; and said electric strike apparatus further including a spring latch formed of a flat leaf-type spring mounted adjacent said notch and extending into the path of said latch or dead bolt and into the path of said shutter, said spring latch positioned for contact with said latch or dead bolt as said latch or dead bolt is extended into said notch, said spring latch being urged out of the path of said shutter by contact with said latch or dead bolt.

3. In an Electric Strike apparatus having a strike frame with a front face plate and a jam face plate and including means defining a notch in said strike frame for receiving a latch or dead bolt, the improvement comprising a shutter positioned adjacent said front face plate, said shutter moveable between a first position exposing said notch and a second position covering at least a portion of said notch to prevent passage of said latch or dead bolt through said portion of said notch; a spring latch positioned adjacent said notch and extending into the path of said latch or dead bolt as said bolt is extended into said notch, and extending into the path of said shutter as said shutter moves from said first position to said second position, said latch being urged out of the path of said shutter by contact with said latch or dead bolt.

* * * * *